US007814585B1

(12) United States Patent
Reich

(10) Patent No.: US 7,814,585 B1
(45) Date of Patent: Oct. 19, 2010

(54) DENTAL SHOWER WATER PICK

(76) Inventor: Bonnie E. Reich, 9231 Via Classico East, Wellington, FL (US) 33411-6510

( * ) Notice: Subject to any disclaimer, the term of this patent is extended or adjusted under 35 U.S.C. 154(b) by 1024 days.

(21) Appl. No.: 11/591,663

(22) Filed: Oct. 30, 2006

(51) Int. Cl.
*A47K 3/022* (2006.01)

(52) U.S. Cl. ..... 4/615; 4/601; 4/567; 4/605; 4/597

(58) Field of Classification Search ..... 4/615, 4/601, 605, 596, 597, 567, 903; 601/155, 601/166, 165; 137/624.13, 624.14
See application file for complete search history.

(56) References Cited

U.S. PATENT DOCUMENTS 4,607,627 A * 8/1986 Leber et al. ..... 601/162
5,218,956 A * 6/1993 Handler et al. ..... 601/155
5,626,472 A * 5/1997 Pennetta ..... 601/165

* cited by examiner

*Primary Examiner*—Khoa D Huynh
(74) *Attorney, Agent, or Firm*—Oltman Flynn & Kubler

(57) ABSTRACT

A show head water pick apparatus includes a first pipe segment for attachment to a shower pipe protruding outwardly from shower stall wall and having a first pipe segment outward end; a switch valve having a switch valve intake end connected to the first pipe segment outward end, and having a shower head output branch to which a shower head is connected and a water pick output branch, and having a valve operation handle for delivering water flow alternately to the shower head and to the water pulsing and pick assembly; a water pulsing unit connected to the water pick output branch; a water pick tube having a tube first end and a tube second end, the tube first end being connected to the water pulsing unit; and a water pick secured to the tube second end.

11 Claims, 19 Drawing Sheets

DENTAL SHOWER WATER PICK

BACKGROUND OF THE INVENTION

1. Field of the Invention

The present invention relates generally to the field of water delivery fixtures. More specifically the present invention relates to a hybrid shower head water pick apparatus which combines a dental water pick and a shower head for alternate use so that water pick dental cleaning can be conducted in the shower. The apparatus includes a first pipe segment fitted with an attachment nut for screwing onto a threaded end of a shower pipe protruding outwardly from shower stall wall, a flow directing switch valve having a shuttle valve intake end which is secured to the first pipe segment outward end, and having a shower head output branch to which a shower head is secured with the shower stream ports directed outwardly into the shower stall and a water pick output branch to which a water pulsing and pick assembly is secured, and having a valve operation handle for delivering water flow alternatively to the shower head and to the water pulsing and pick assembly.

The water pulsing and pick assembly preferably includes a water pulsing unit secured to the water pick output branch, a flexible water pick tube having a tube first end and a tube second end, the tube first end being secured to the water pulsing unit, and a water pick secured to the tube second end. A tube supporting hook preferably engages and protrudes laterally downward from the first pipe segment.

The flexible water pick tube preferably is a hydrodynamic hose, and the tube first end preferably includes a tube attachment nut for securing the tube first end to the water pulsing unit. The shower head preferably is conventional. The water pick preferably is also conventional, and includes a tubular pick body in the form of a pick handle segment including a pick valve and having a handle segment first end secured to the tube second end and a pick nozzle secured to the handle segment second end. The pick valve preferably includes an actuator button which turns the water pick on and off. The pick nozzle preferably is a hollow needle nozzle having a nozzle longitudinal curve for improved access to a variety of tooth and gum locations, and preferably is formed of plastic and is replaceable. An inventive water pulsing unit is provided including a spring-loaded diaphragm and duel valves, which cause the diaphragm to oscillate and release pulses of water through the water pick.

2. Description of the Prior Art

There have long been water picks for connecting to sink faucets to clean teeth and gums, and shower heads for connecting to shower pipes for cleaning the rest of the body. A shower stall fully contains the water sprayed from the shower head, but nothing prevents water scattered by a sink-mounted water pick from spotting bathroom surfaces such as mirrors. In addition, dental cleaning with the water pick becomes a separate task from showering, requiring mounting and removing the water pick from the sink faucet before and after use.

It is thus an object of the present invention to provide a shower water pick which is connected to the shower water supply together with the shower head and thus is used in the shower stall so that showering and water pick dental cleaning become a single combined task, and so that spray from the water pick is contained within the stall and washed down the shower drain.

It is another object of the present invention to provide such a shower water pick in which the water pick is mounted to an end of a flexible tube so that the water pick can be lowered to the level of a user mouth and maneuvered as needed, and subsequently hung on the shower pipe to be out of the way behind the shower head.

It is still another object of the present invention to provide such a shower water pick which is easy to use.

It is finally an object of the present invention to provide such a shower water pick which is durable and inexpensive to manufacture.

SUMMARY OF THE INVENTION

The present invention accomplishes the above-stated objectives, as well as others, as may be determined by a fair reading and interpretation of the entire specification.

A show head water pick apparatus is provided, including a first pipe segment for attachment to a shower pipe protruding outwardly from shower stall wall and having a first pipe segment outward end; a switch valve having a switch valve intake end connected to the first pipe segment outward end, and having a shower head output branch to which a shower head is connected and a water pick output branch, and having a valve operation handle for delivering water flow alternately to the shower head and to the water pulsing and pick assembly; a water pulsing unit connected to the water pick output branch; a water pick tube having a tube first end and a tube second end, the tube first end being connected to the water pulsing unit; and a water pick secured to the tube second end.

The apparatus preferably additionally includes a tube supporting hook protruding laterally from the first pipe segment for hanging the water pick tube. The water pick tube preferably is a hydrodynamic hose. The water pulsing unit preferably has an externally threaded fitting and where the tube first end includes a tube attachment nut for securing the tube first end to the water pulsing unit. The water pick preferably includes a tubular pick body in the form of a pick handle segment comprising a pick valve and having a handle segment first end secured to the tube second end and a pick handle segment second end to which a nozzle is secured. The pick valve preferably includes an actuator button for turning the water pick on and off.

The water pulsing unit preferably includes a water pulsing unit housing having a housing wall and containing a flexible shuttle diaphragm peripherally mounted within the housing and dividing the interior of the housing into a housing entry chamber and a housing exit chamber and having a central diaphragm port, and having a housing intake passageway for securing to the water pick output branch of the switch valve, the housing intake passageway opening into the housing entry chamber defined by the housing wall and by a first face of the flexible shuttle diaphragm, and having a housing output passageway for securing to the water pick tube, the housing output passageway opening from the housing exit chamber defined by the housing wall and a second face of the flexible shuttle diaphragm; a pulsing mechanism within the housing and including the flexible shuttle diaphragm and a double valve assembly passing through the diaphragm port; the double valve assembly including an entry chamber valve controlling water flow between the entry chamber and the exterior of the housing, which closes to permit water pressure to rise within the entry chamber and which opens to permit water to escape from the entry chamber through the housing wall to cause water pressure to fall within the entry chamber, and including an exit chamber check valve which opens to permit water to flow from the entry chamber into the exit chamber and out of the housing output passageway to the water pick when the entry chamber valve is closed, and which closes to prevent water flow from the exit chamber and from the housing output passageway and water pick from entering the entry chamber when the entry chamber valve is open and water pressure within the entry chamber is thus lower, thereby permitting water pressure within the exit chamber to remain stable while resilient force of a diaphragm spring bearing against the diaphragm deflects the diaphragm back into the entry chamber, overcoming diminished force of lower entry chamber water pressure, and the diaphragm deflection cycle repeats to produce water pulses passing through the housing output passageway and through the water pick tube and the water pick.

A water pick and pick connection fitting apparatus, including a pipe T-fitting having a first pipe segment defining a water receiving segment for attachment to a water supply pipe, and an output branch in fluid communication with the first pipe segment and to which a water output means is connected, a water pick output branch in fluid communication with the first pipe segment; and a water pick assembly attached to the water pick output branch. The water pick assembly preferably includes a water pulsing unit connected to the water pick output branch; a water pick tube having a tube first end and a tube second end, the tube first end being connected to the water pulsing unit; and a water pick secured to the tube second end. The apparatus optionally additionally includes a valve in the pipe T-fitting.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
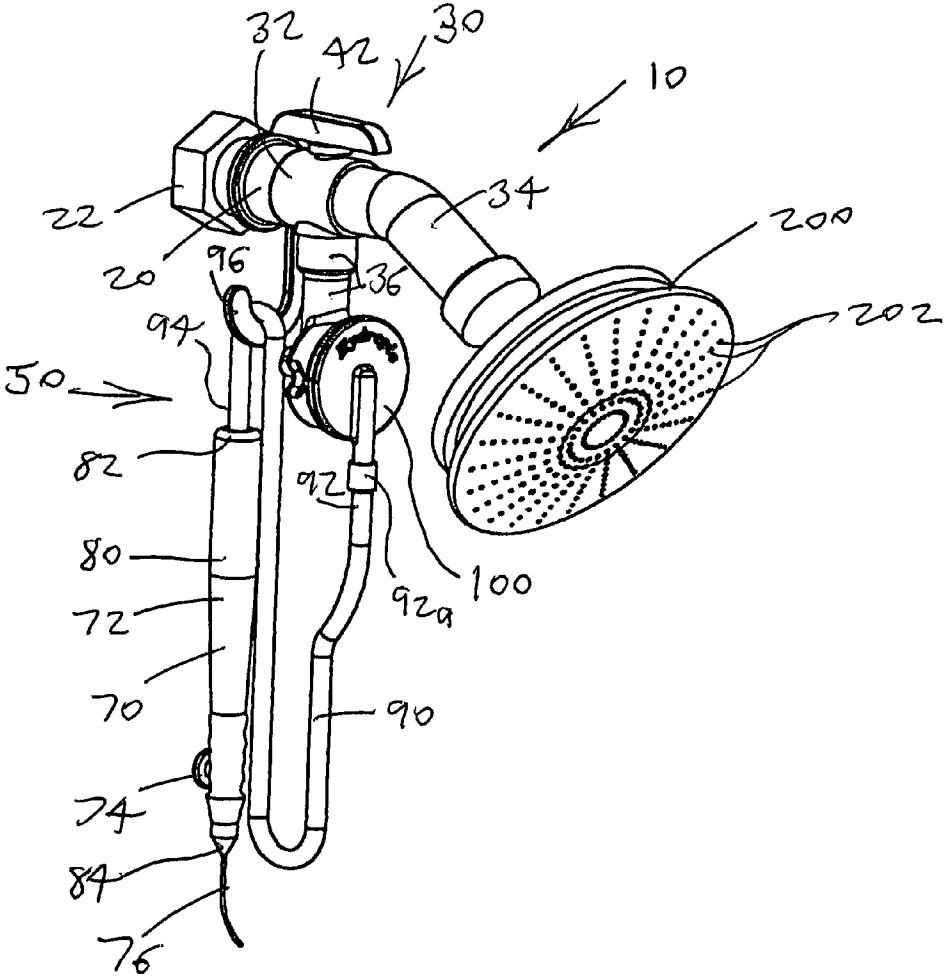
FIG. 1 is a perspective front view of the preferred embodiment of the present shower head water pick apparatus mounted to a shower pipe.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
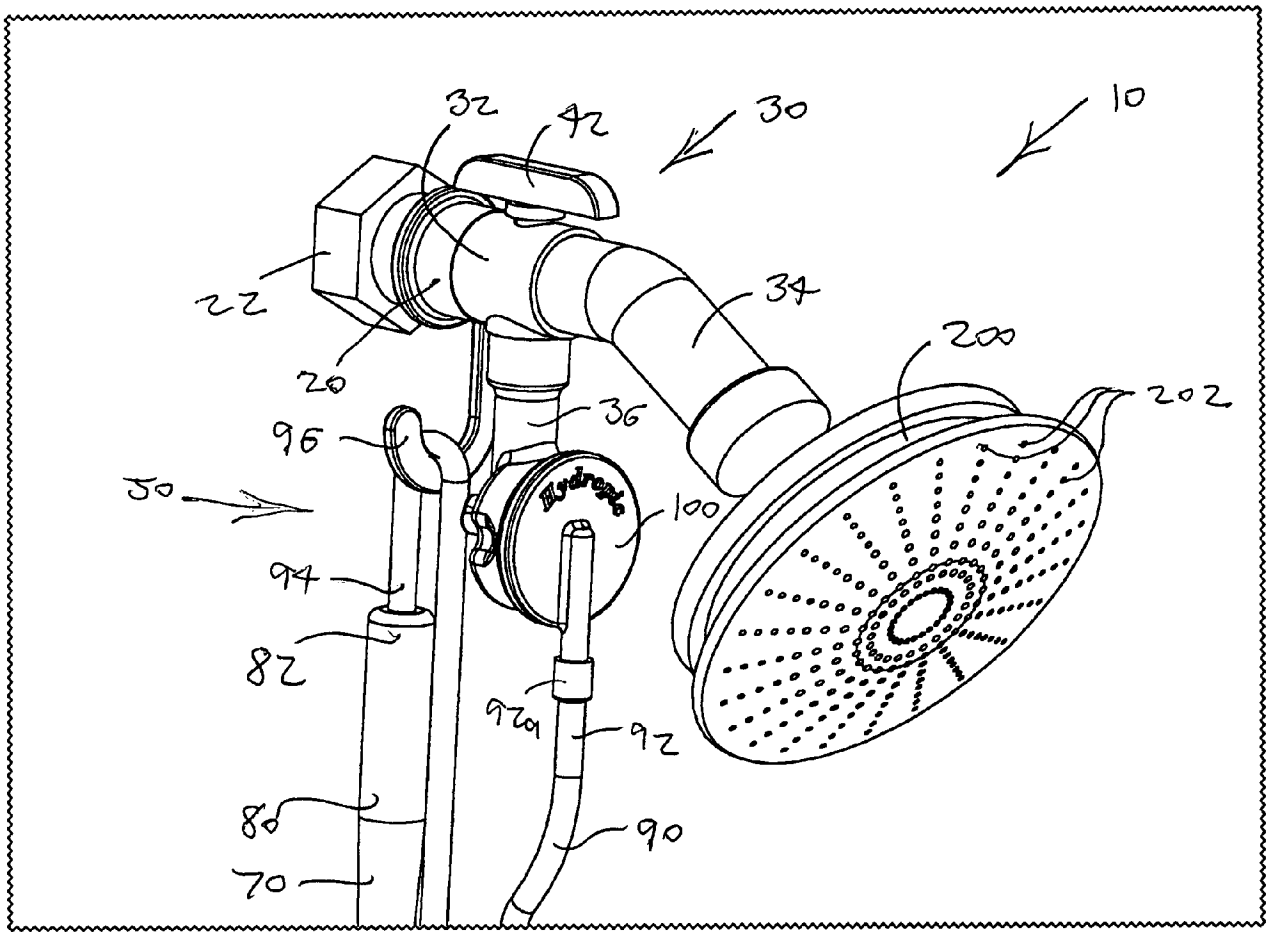
FIG. 2 is a close-up view of the switch valve and shower head as in FIG. 1.
Figure 3:
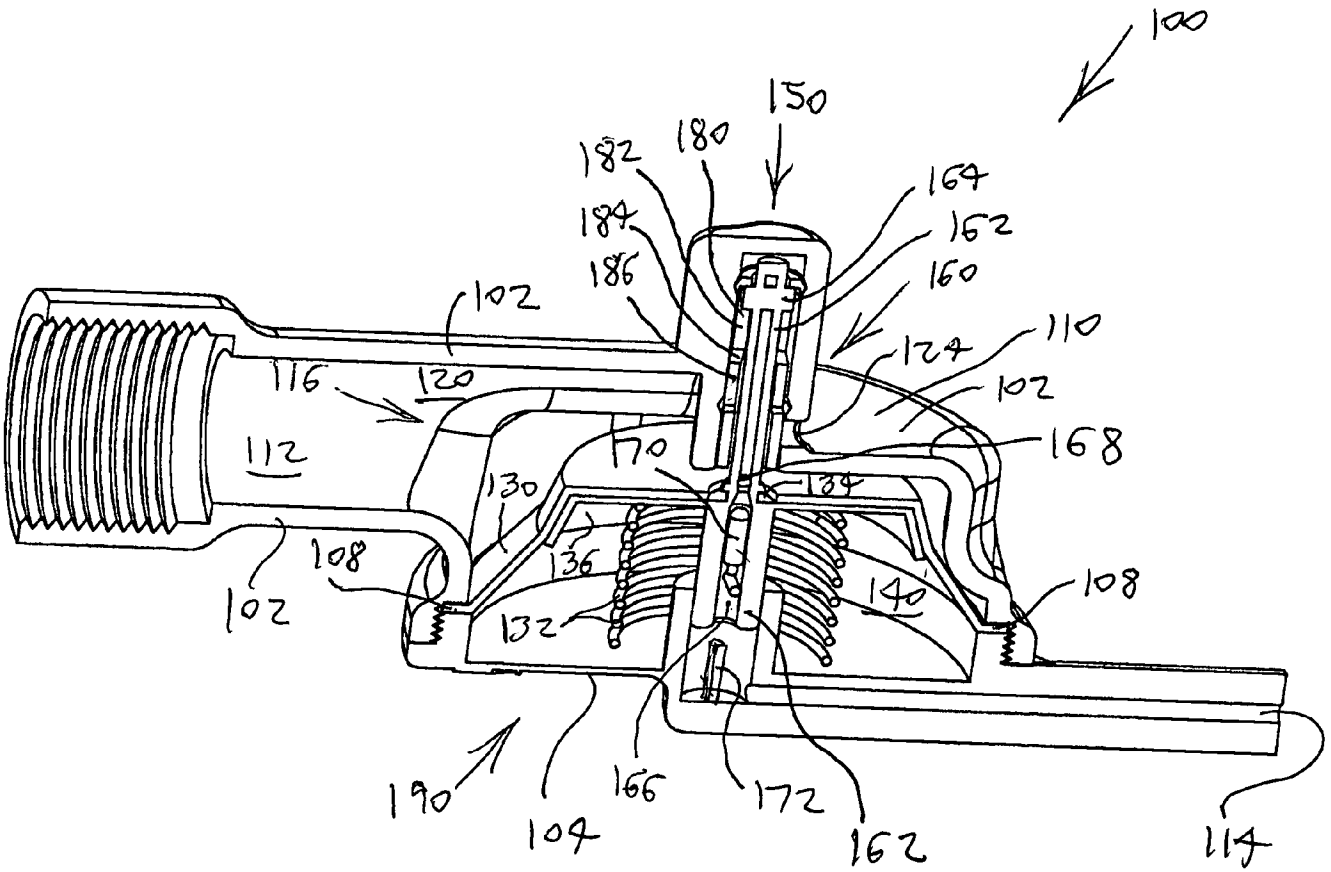
FIG. 3 is a perspective cross-sectional side view of the water pulsing unit.
Figure 4:
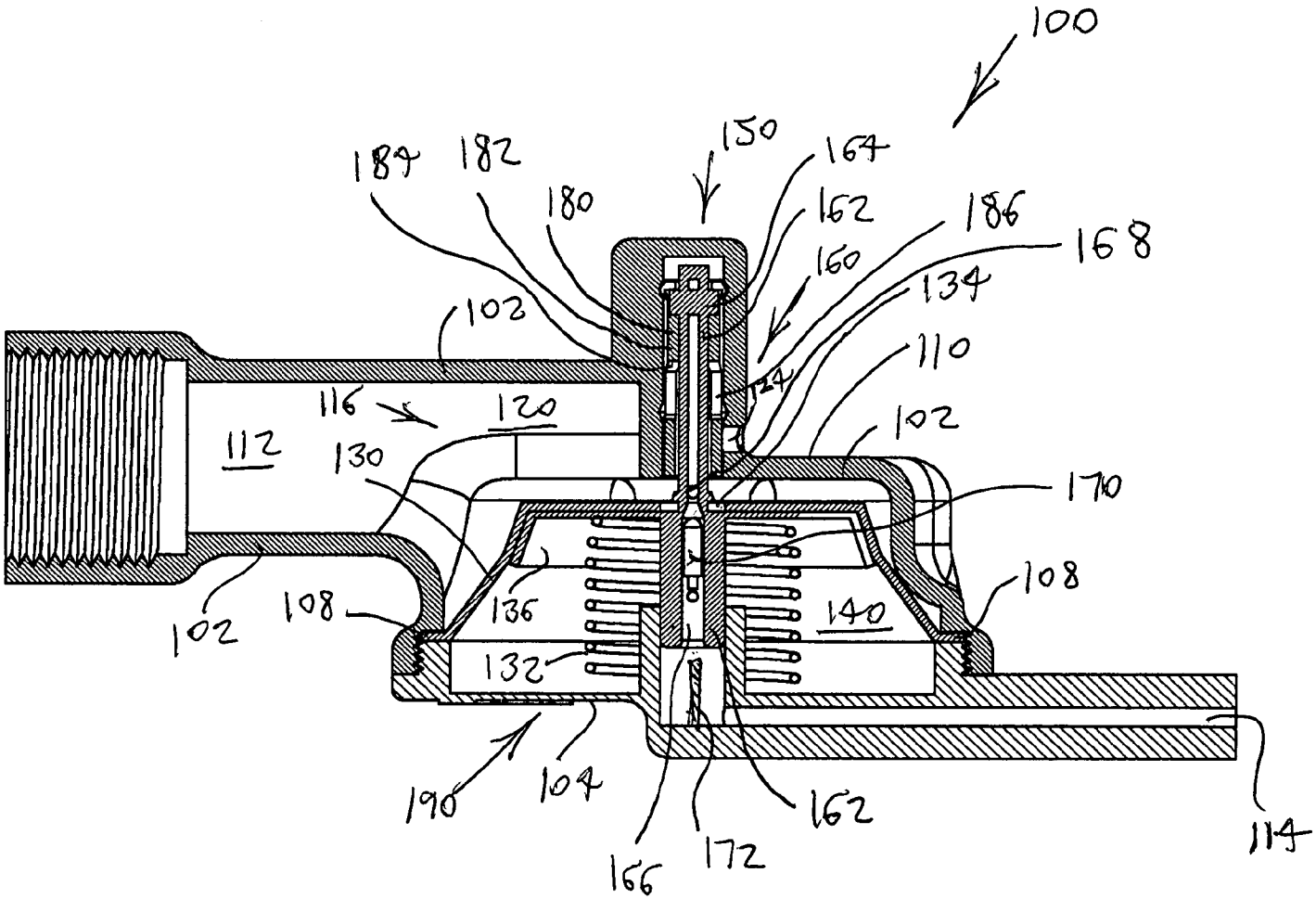
FIG. 4 is a cross-sectional side view of the water pulsing unit.
Figure 5:
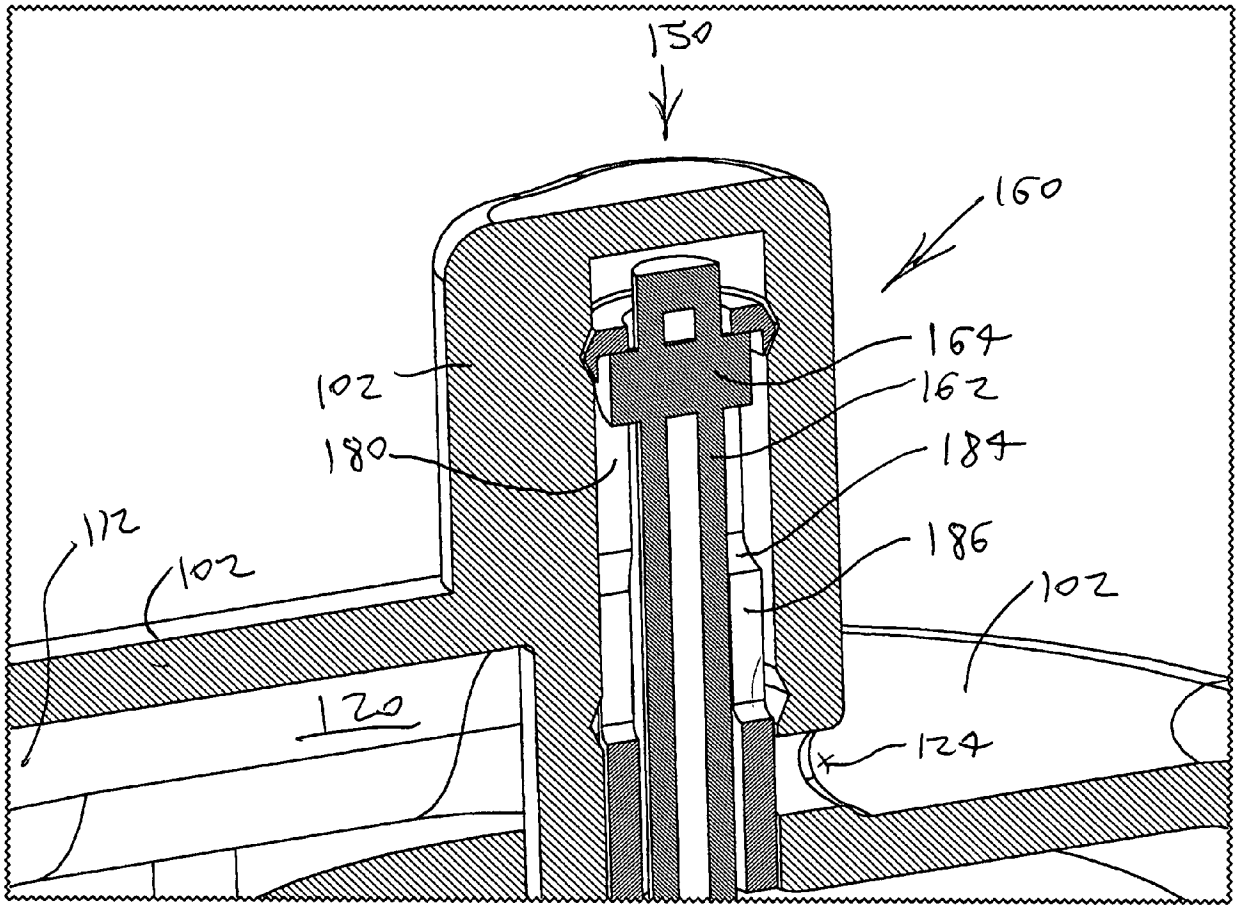
FIG. 5 is a cross-sectional side view of the valve tube and the diametrically protruding guide bar riding within diametrically opposing guide slots in the valve guide sleeve and the guide slot step.
Figure 6:
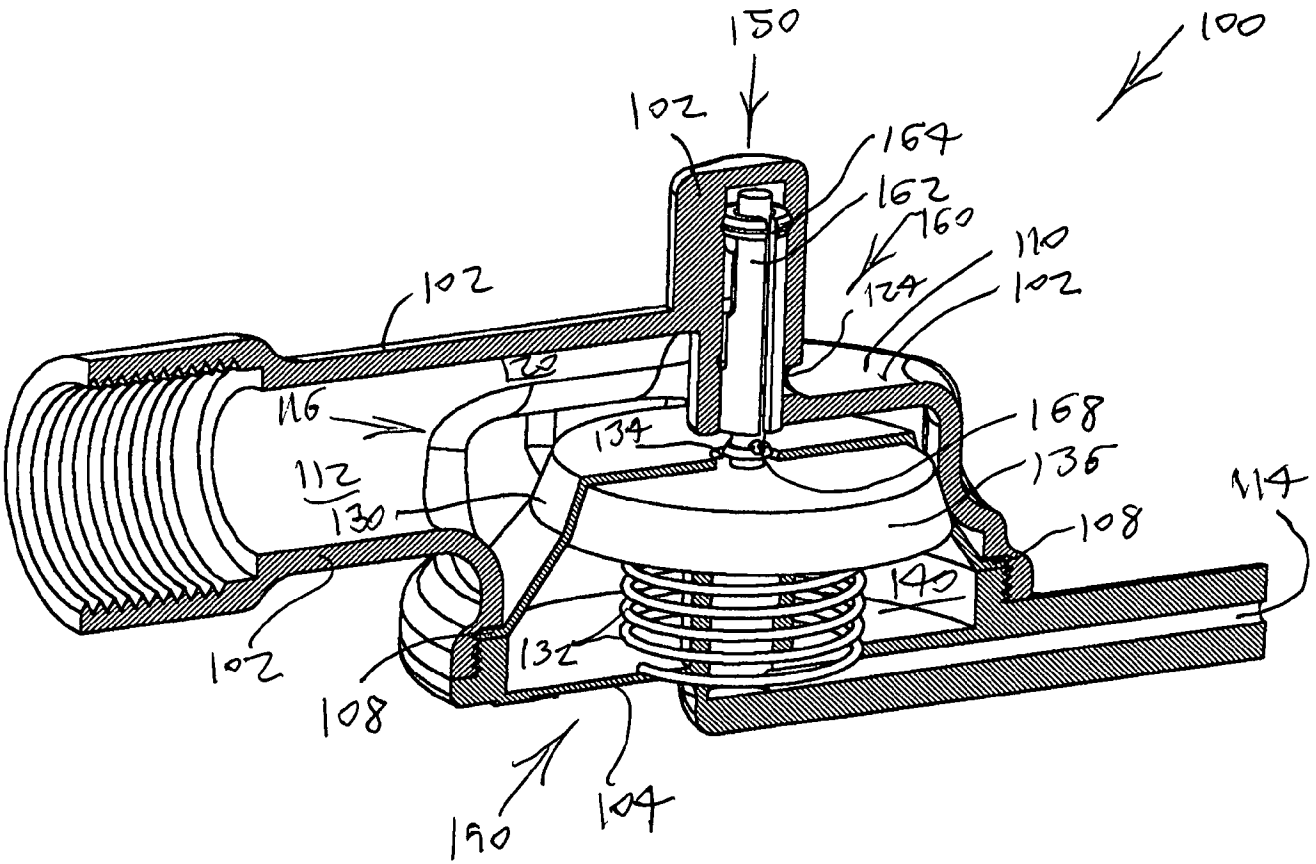
FIG. 6 is another perspective cross-sectional side view of the water pulsing unit, similar to that of FIG. 3.
Figure 7:
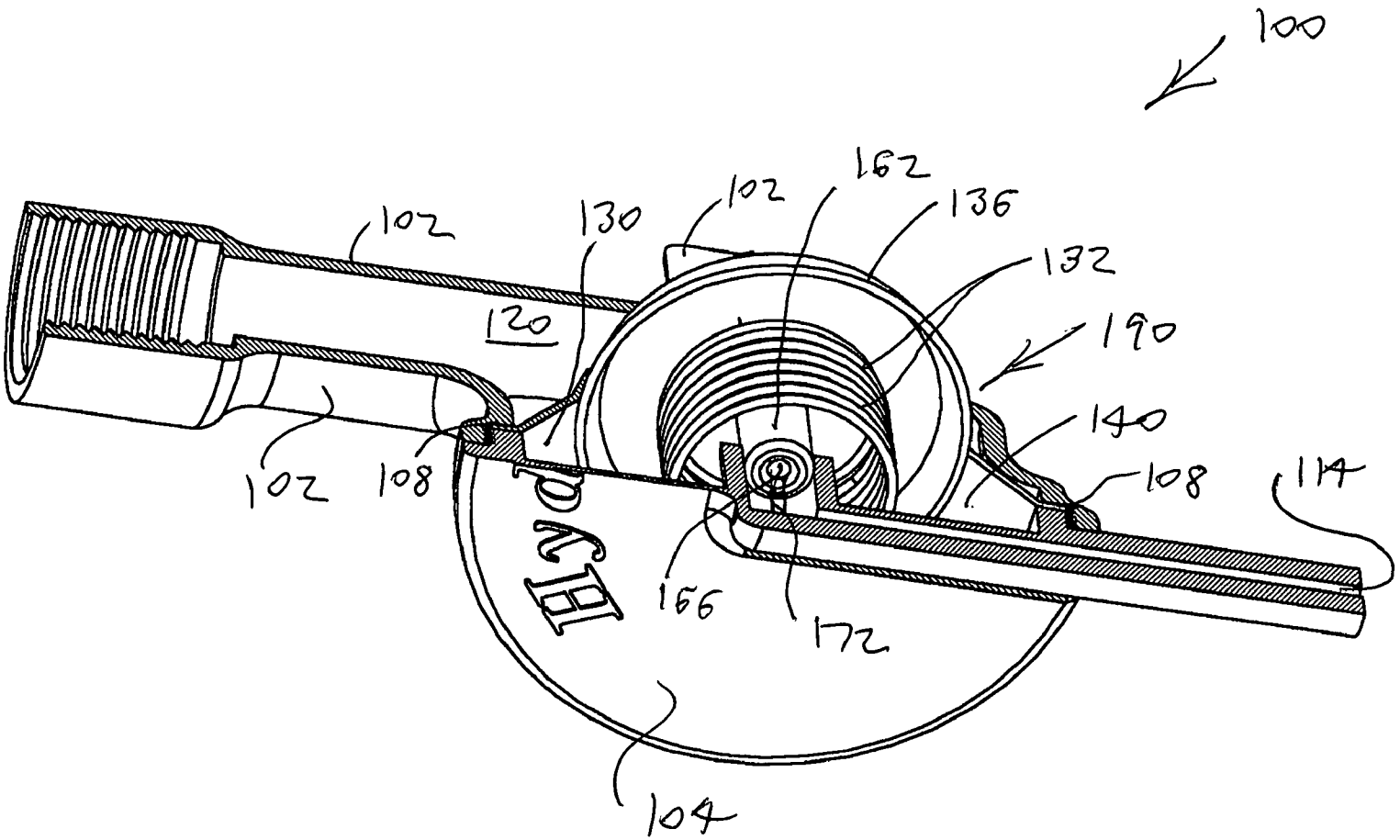
FIG. 7 is another perspective cross-sectional side view of the water pulsing unit from the housing exit chamber side of water pulsing unit.
Figure 8:
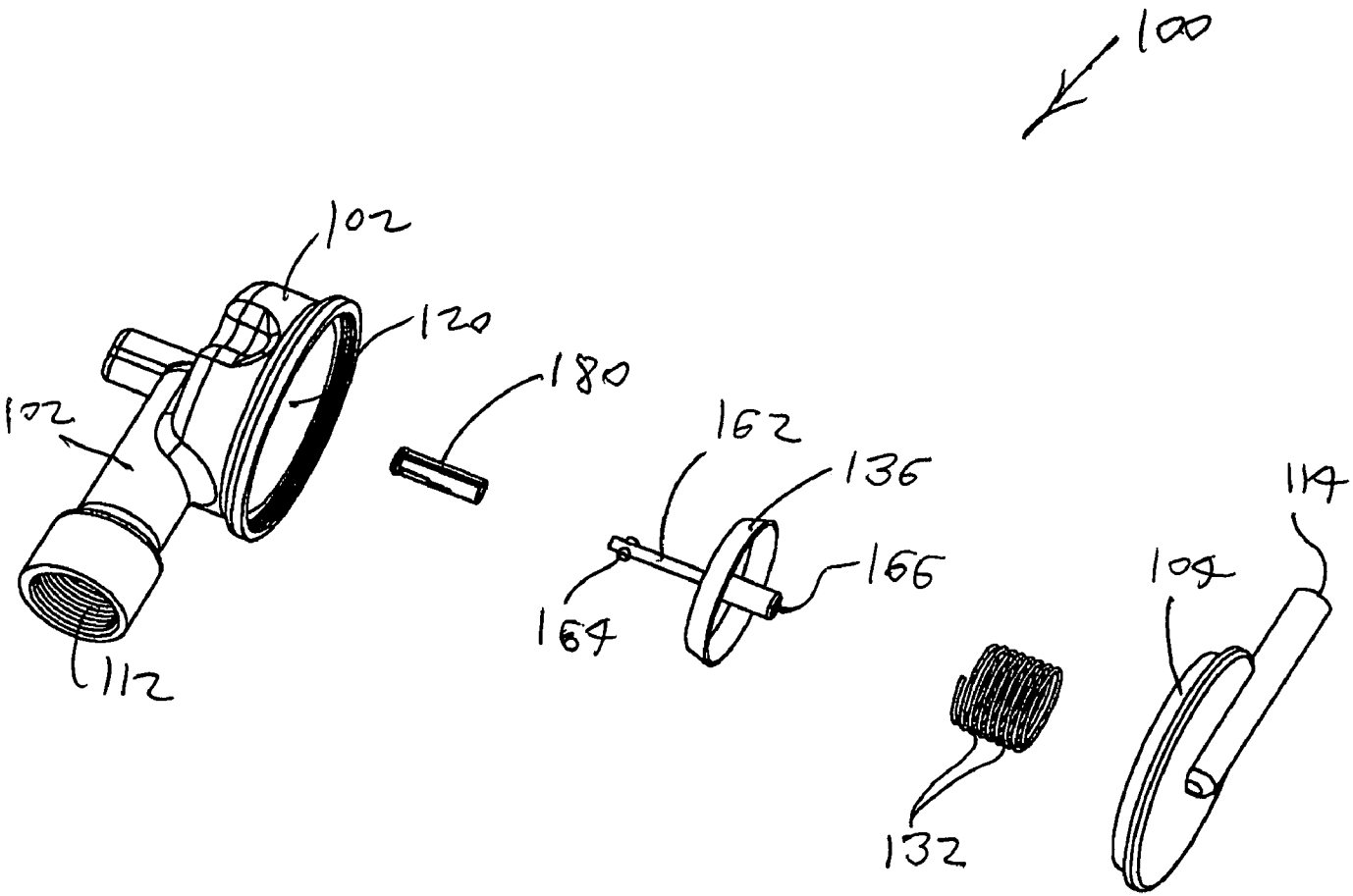
FIG. 8 is an exploded view of the preferred water pulsing unit.
Figure 9:
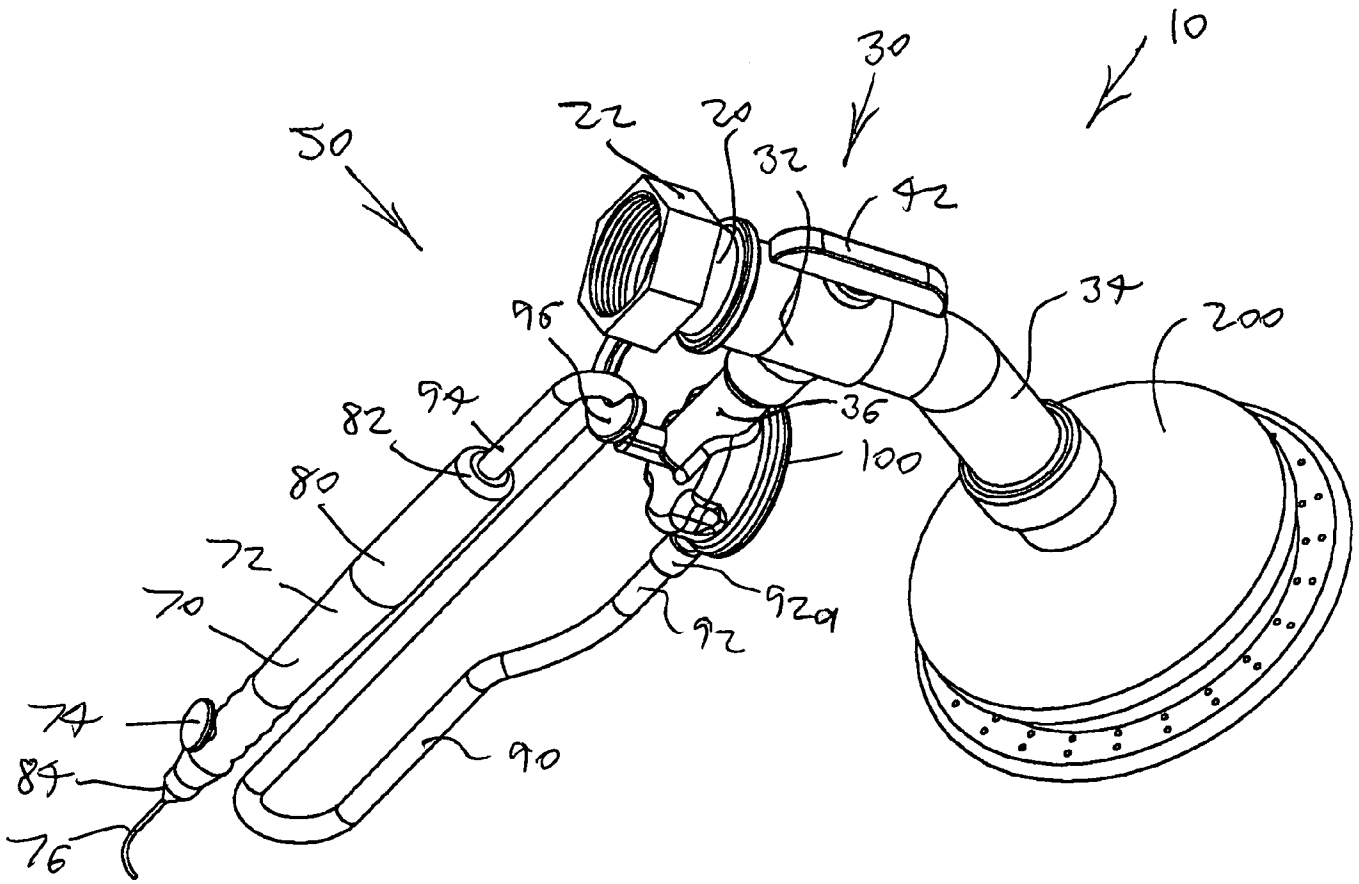
FIG. 9 is a perspective rear view of the preferred embodiment of the present shower head water pick apparatus.
Figure 10:
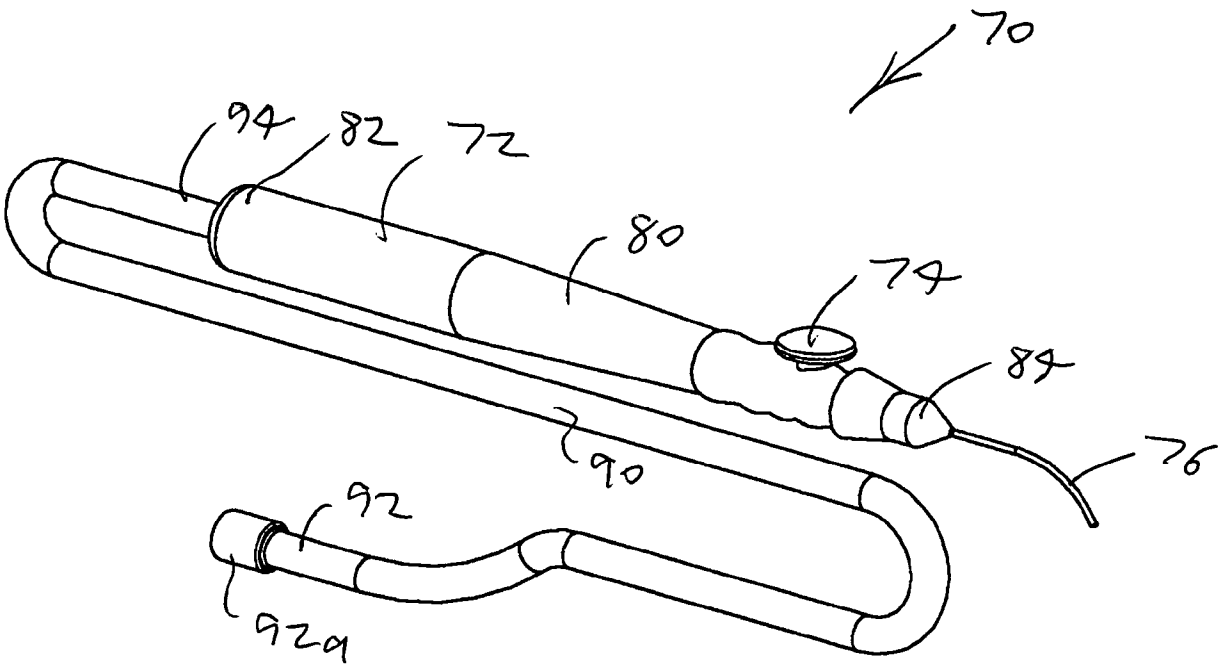
FIG. 10 is a perspective view of the preferred water pick.
Figure 11:
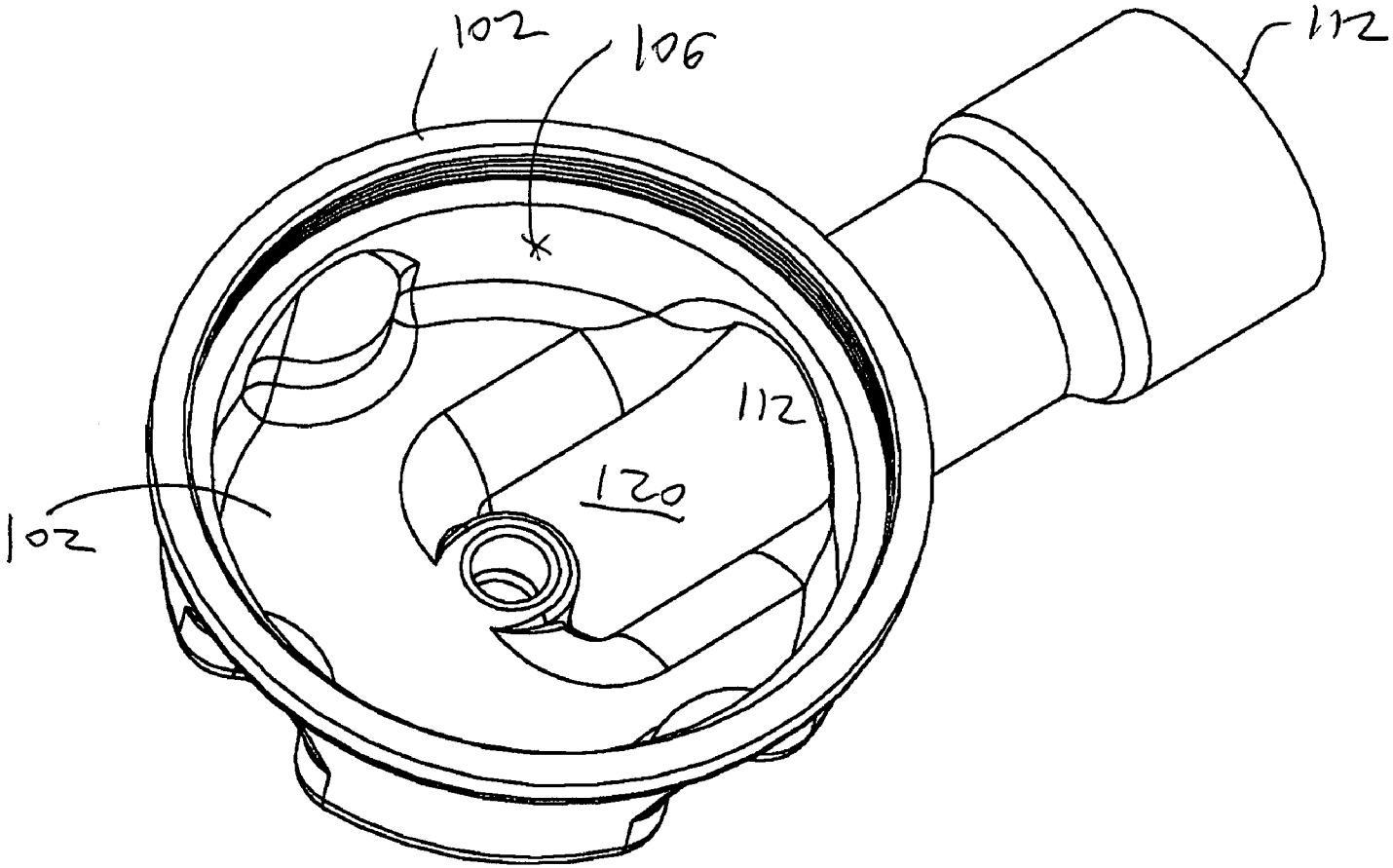
FIG. 11 is a perspective view of the water pulsing housing through the housing access opening with the housing cap and shuttle diaphragm removed.
Figure 12:
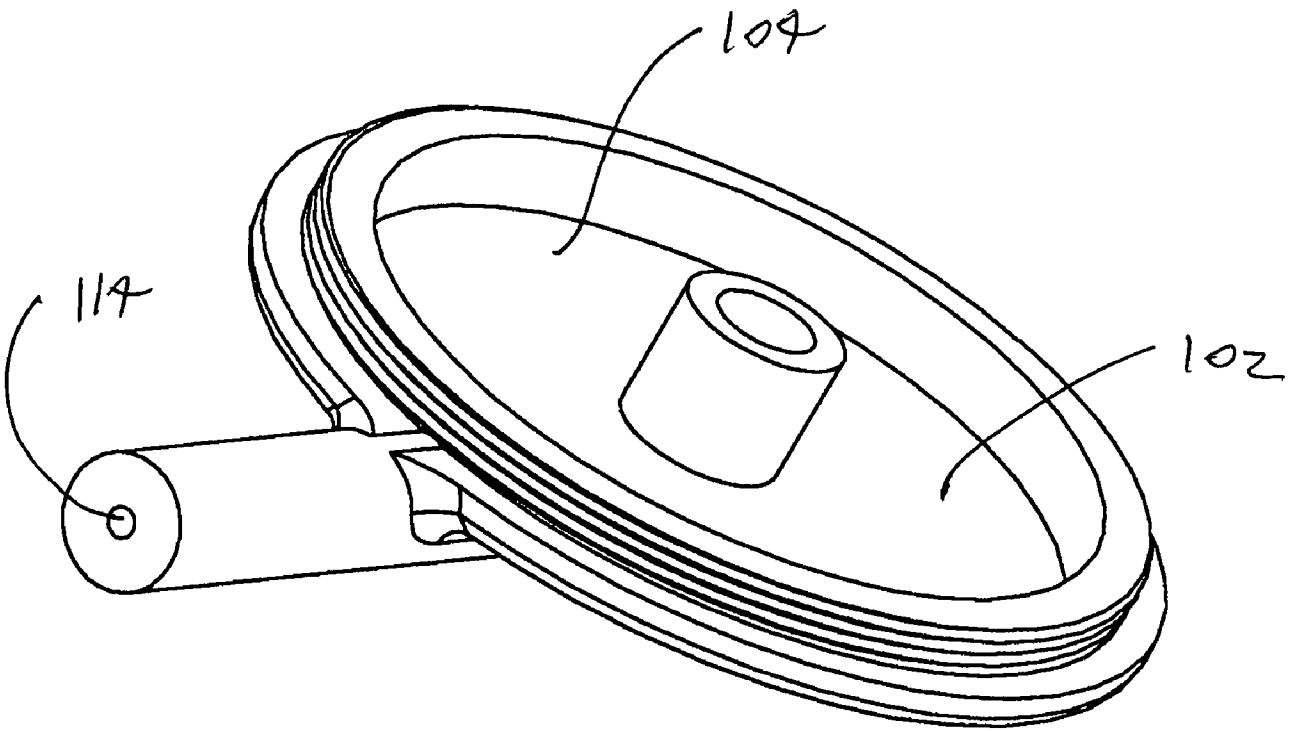
FIG. 12 is a perspective view of the preferred combined housing cap and housing output passageway.
Figure 13:
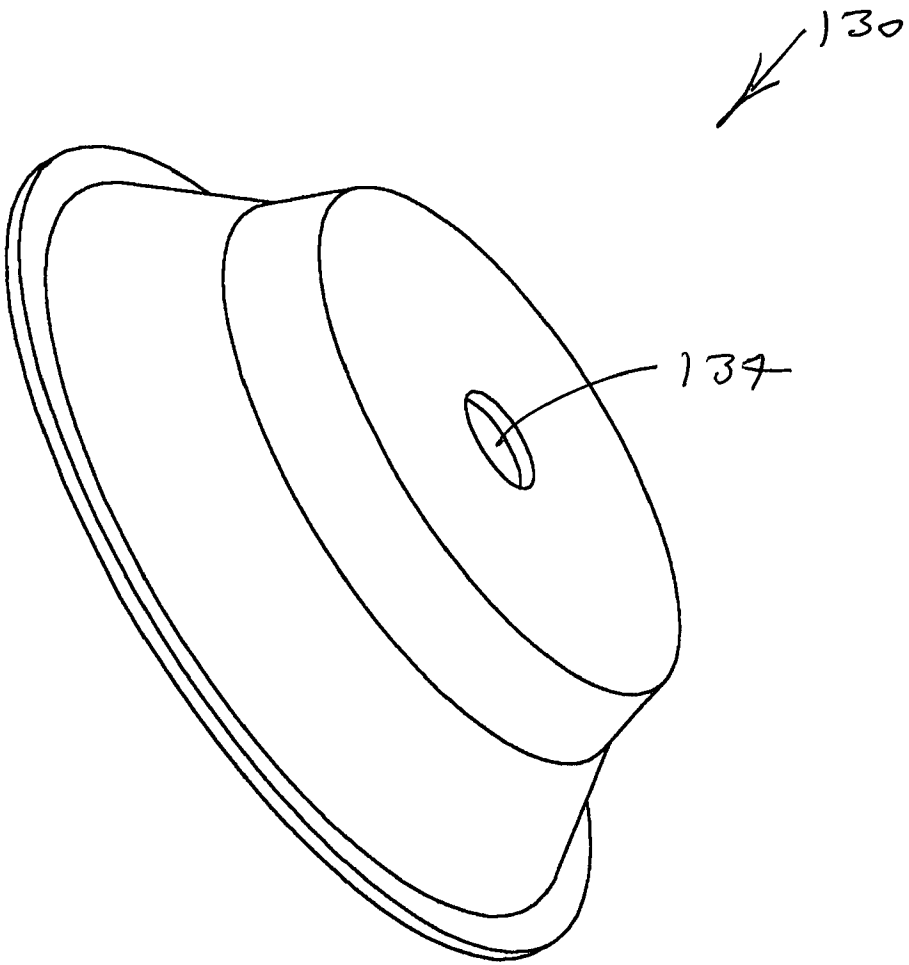
FIG. 13 is a perspective view of the preferred shuttle diaphragm.
Figure 14:
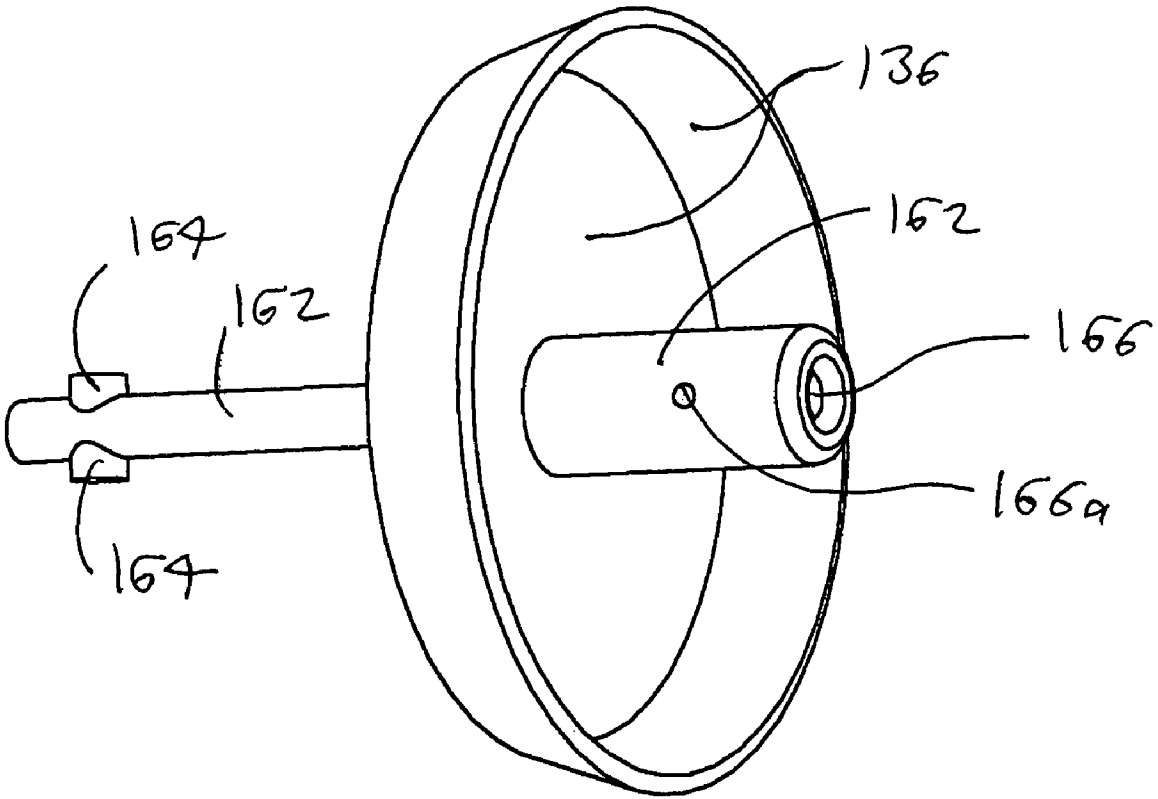
FIG. 14 is a perspective view of the preferred combined valve tube and spring skirt.
Figure 15:
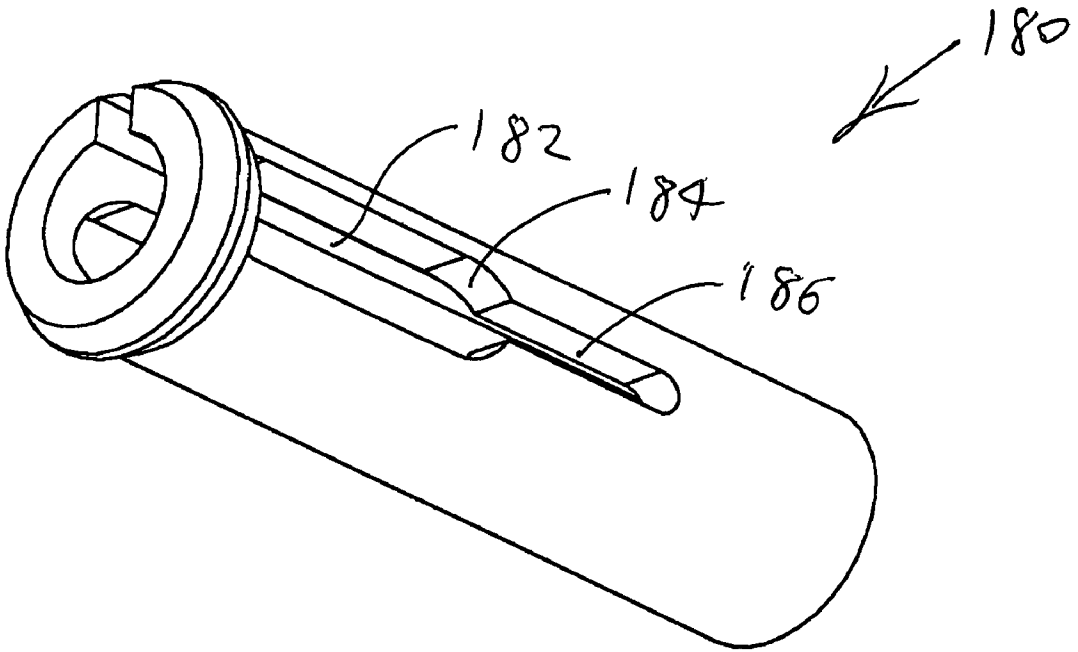
FIG. 15 is a perspective view of the valve tube guide sleeve and one of the guide slots.
Figure 16:
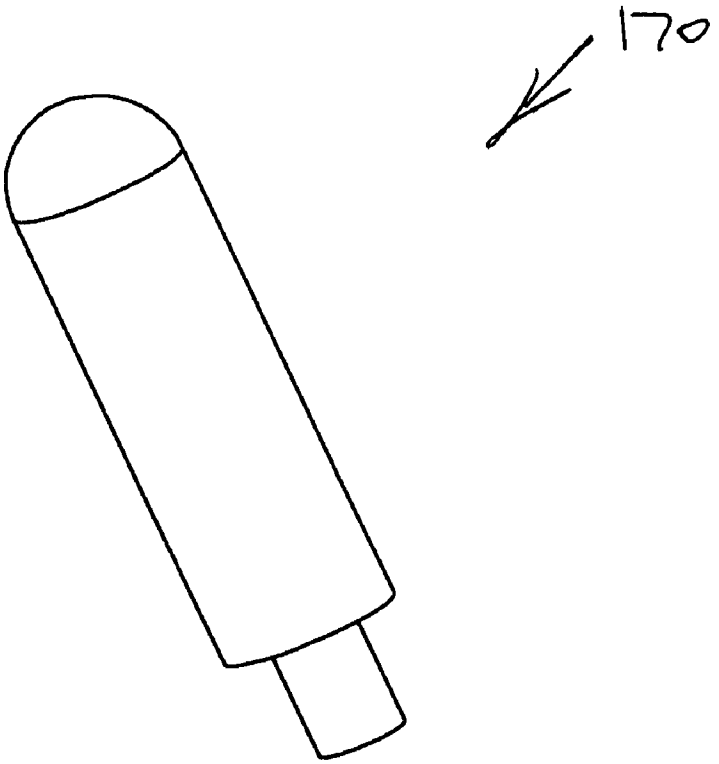
FIG. 16 is a side view of the bullet shuttle.
Figure 17:
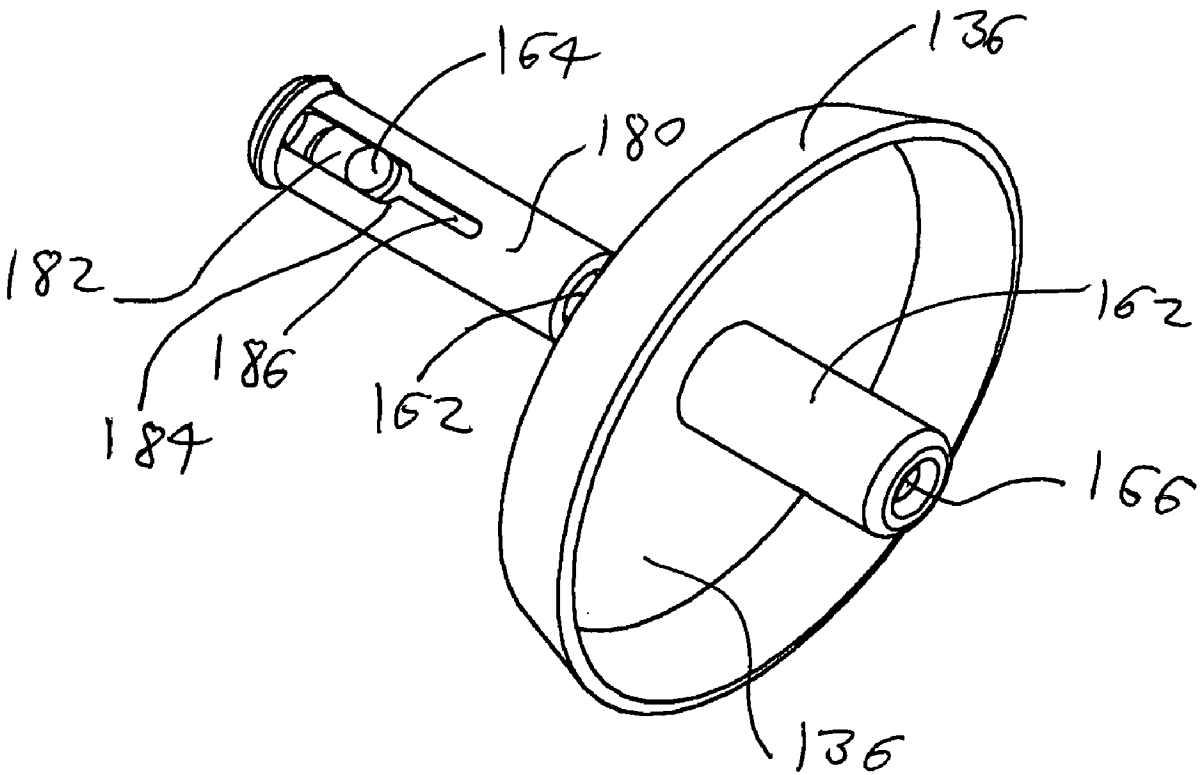
FIG. 17 is a perspective view of the preferred combined valve tube and spring skirt as in FIG. 14, with the valve tube and guide bar added.
Figure 18:
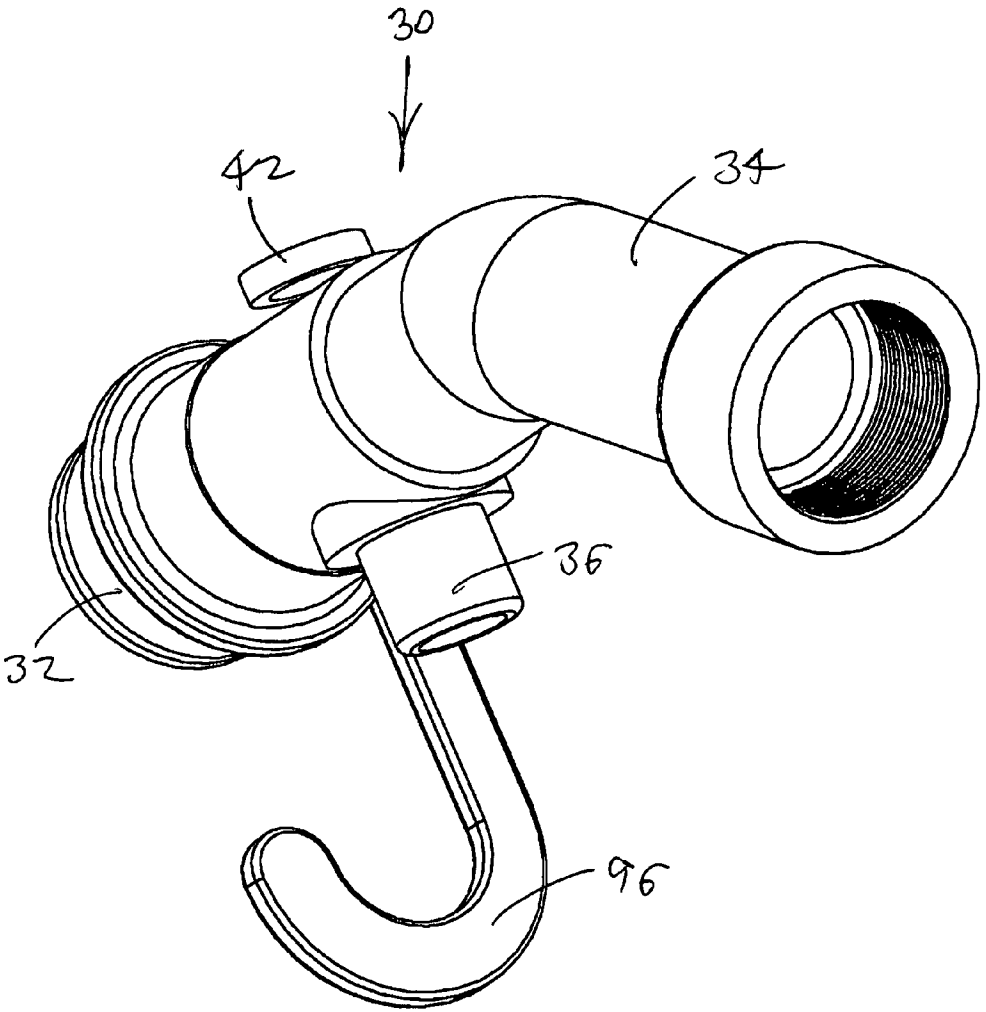
FIG. 18 is a perspective front view of the preferred switch valve, first pipe segment and tube supporting hook.
Figure 19:
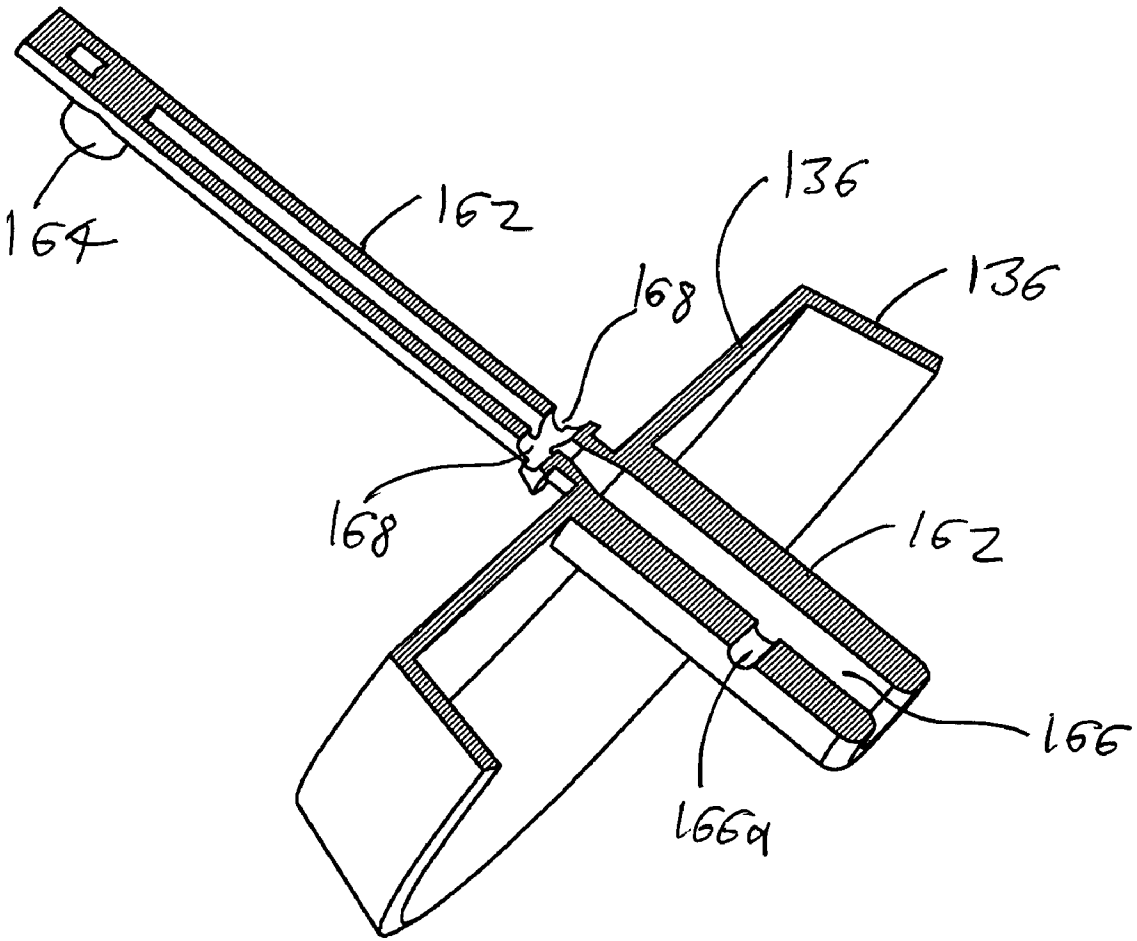
FIG. 19 is a cross-sectional perspective side view of the preferred combined valve tube and spring skirt, showing the lateral raceway port and the guide tube ports in cross-section.

Referring to FIGS. 1-19, a shower head water pick apparatus 10 is disclosed which combines a dental water pick 70 and a shower head 200 for alternate use so that water pick 100 dental cleaning can be conducted in the shower. Apparatus 10 includes a first pipe segment 20 fitted with an attachment nut 22 for screwing onto a threaded end of a shower pipe P protruding outwardly from shower stall wall W, a flow directing switch valve 30 having a switch valve intake end 32 which is secured to the first pipe segment 20 outward end, and having a shower head output branch 34 to which a shower head 200 is secured with the shower head stream ports 202 directed outwardly into the shower stall and having a water pick output branch 36 to which a water pulsing and pick assembly 50 is secured, and a having valve operation handle 42 for directing water flow alternatively to the shower head 200 and to the water pulsing and pick assembly 50. The water pulsing and pick assembly 50 preferably includes a water pulsing unit 100 secured to the water pick output branch 36, a flexible water pick tube 90 having a tube first end and a tube second end 94, the tube first end 92 being secured to the water pulsing unit 100, and a water pick 70 secured to the tube second end 94. A tube supporting hook 96 preferably engages and protrudes laterally downward from the first pipe segment 20.

The flexible water pick tube 90 preferably is a hydrodynamic hose, and the tube first end 92 preferably includes a tube attachment nut 92*a* for securing the tube first end 92 to the water pulsing unit 100. The shower head 200 preferably is conventional. The water pick 70 preferably is also conventional, and includes a tubular pick body 72 in the form of a pick handle segment 80 including a pick valve 74 and having a handle segment first end 82 secured to the tube second end 94 and a pick nozzle 76 secured to the handle segment second end 84. The pick valve 74 preferably includes an actuator button which turns the water pick 70 on and off. The pick nozzle 76 preferably is a hollow needle nozzle having a nozzle 76 longitudinal curve for improved access to a variety of tooth and gum locations, and preferably is formed of plastic and is replaceable.

The water pulsing unit 100 preferably includes a water pulsing unit housing 110 having a housing intake passageway 112 for securing to the water pick output branch 36 of the switch valve 30, the housing intake passageway 112 opening into a housing entry chamber 120 defined by the housing wall 102 and by a first face of a flexible shuttle diaphragm 130 biased by a diaphragm spring 132, and a housing output passageway 114 for securing to the tube first end 92, the housing output passageway 114 opening from a housing exit chamber 140 defined by the housing wall 102 and a second face of the flexible shuttle diaphragm 130, the portion of the housing wall defining part of the housing exit chamber 140 including a housing cap 104 for removably and sealingly fitting to a housing access opening 106. The housing 110 contains a pulsing mechanism 116 including the flexible shuttle diaphragm 130 which has a central diaphragm port 132 through which a double valve assembly 150 passes. The double valve assembly 150 includes an entry chamber valve 160 controlling water flow between the entry chamber 120 and the exterior of the housing 110, which closes to permit water pressure to rise within the entry chamber 120 and which opens to permit water to escape from the entry chamber 120 through the housing wall 102 to cause water pressure to fall within the entry chamber 120; and includes an exit chamber check valve 190 which opens to permit water to flow from the entry chamber 120 into the exit chamber 140 and out of the housing output passageway 114 to the water pick 70 when the entry chamber valve 160 is closed, and which closes to prevent water flow from the exit chamber 140 and from the housing output passageway 114 and water pick 70 from entering the entry chamber 120 when the entry chamber valve 160 is open and entry chamber 120 water pressure is therefore lower, thus permitting water pressure within the exit chamber 140 to remain stable while the force of the diaphragm spring 132 deflects the diaphragm 130 back toward the entry chamber 120, overcoming the diminished force of lower entry chamber 120 water pressure. This diaphragm 130 deflection cycle repeats to produce water pulses passing through housing output passageway 114 and out of the water pick 70.

The double valve assembly 150 preferably is a single assembly defining both the entry chamber valve 160 and the exit chamber check valve 190. The entry chamber valve 160 preferably includes a valve tube 162 slidably retained within a valve tube guide sleeve 180 mounted within an entry chamber valve tunnel 122 in portion of the housing wall 102 forming part of the entry chamber 120 and an opposing exit chamber valve tunnel 142 in the portion of the housing wall 102 forming the housing cap 104 part of the exit chamber 140. The valve tube 162 has diametrically opposing guide tube ports 168 opening into the housing entry chamber 120 outside the entry chamber valve tunnel 122, and has a diametrically protruding guide bar 164 riding within diametrically opposing guide slots 182 in the valve guide sleeve 180 which narrows toward the exit chamber end of the sleeve 180 in a guide slot stop step 184 which the guide bar 164 abuts as the valve tube 162 advances toward the exit chamber 140, causing the valve guide sleeve 180 to begin advancing with the valve tube 162 toward the exit chamber 140. The guide slots 182 have narrower guide slot water passage segments 186 beyond the guide slot stop step 184 which are too narrow for the guide bar 164 to enter, and when the valve guide sleeve 180 advances a certain distance toward the exit chamber 140, the entry chamber valve 160 opens as a result of the guide slot water passage segments 186 aligning and registering with an entry chamber exit port 124 in the housing wall 102 through which water escapes from the entry chamber 120. Movement of the valve tube away from the exit chamber 140 causes the guide bar 164 to eventually abut an end of the opposing guide slots 182, moving the valve guide sleeve 180 away from the exit chamber 140 and the guide slot water passage segments 186 to move out of alignment with the entry chamber exit port 124 to close the entry chamber valve 160.

The exit chamber check valve 190 preferably includes the valve tube 162 internal surface, and the valve tube 162 internal diameter expands at a valve tube internal bevel 164 substantially where the valve tube 162 passes through the diaphragm port 134 in the diaphragm 130 to define a bullet shuttle raceway 166 within the portion of the valve tube 162 within the exit chamber 140, and a bullet shuttle 170 in the form of a solid cylinder having a bullet-nose shape at each longitudinal end rides loosely and freely within the bullet shuttle raceway 166, lodgingly sealingly in the valve tube internal bevel 164 at one end of the bullet shuttle raceway 166, and abutting a bullet shuttle stop structure 172 protruding from the housing wall 102 to the opposing end of the raceway 166. Lodging of the bullet shuttle 170 sealingly in the valve tube internal bevel 164 closes the exit chamber check valve 190 to prevent water from flowing backward into the entry chamber, thus causing the exit chamber check valve 190 to act as a check valve. Movement of the bullet shuttle 170 out of sealing relationship with the valve tube internal bevel 164 and toward the bullet shuttle stop structure 172 permits water to enter the bullet shuttle raceway 166, flow around the bullet shuttle 170 between the bullet shuttle 170 and the bullet shuttle raceway 166 internal surface and into the exit chamber 140 through a lateral raceway port **166*a* as well as out of the water pulsing unit 100 through the housing output passageway 114**.

A spring skirt 136 extends radially from the valve tube 162 within the exit chamber 140 and abuts the diaphragm 130, distributing the force of the diaphragm spring 132 over a broad area of the diaphragm 130. The diaphragm 130 has a diaphragm peripheral edge which is sealingly mounted within a circumferential internal diaphragm slot 108 in the housing wall 102.

In general terms the first pipe segment 20 defines a water receiving segment for attachment to a water supply pipe which may be a shower pipe but could be any other domestic water supply pipe as well, and the shower head output branch 34 defines a water output branch in fluid communication with the first pipe segment 20, and the water pick output branch 36 in combination with the first pipe segment 20 and the shower head output branch 34 define a pipe T-fitting. The valve mechanism can be omitted from the T-fitting and the T-fitting can be inserted into a break in a domestic water pipe, with the first pipe segment 20 connected to the water pipe upstream end and the shower head output branch being connected to the water pipe downstream end rather than to a shower head 200, and the water pulsing and pick assembly 50 attached to the water pick output branch 36.

Thus the shower head 200 and switch valve 30 may be omitted and the remaining pipe T-fitting and attached water pick 70 be connected into an existing water line such as into a water supply pipe under a sink, so that some of the water is diverted from the sink faucet into the water pick 70.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A shower head water pick apparatus, comprising:

a first pipe segment for attachment to a shower pipe protruding outwardly from shower stall wall and having a first pipe segment outward end;

a switch valve having a switch valve intake end connected to said first pipe segment outward end, and having a shower head output branch to which a shower head is connected and a water pick output branch, and having a valve operation handle for delivering water flow alternately to the shower head and to a water pulsing and pick assembly;

a water pulsing unit connected to said water pick output branch;

a water pick tube having a tube first end and a tube second end, said tube first end being connected to said water pulsing unit, wherein said water pulsing unit comprises: a water pulsing unit housing having a housing wall and containing a flexible shuttle diaphragm peripherally mounted within said housing and dividing the interior of said housing into a housing entry chamber and a housing exit chamber and having a central diaphragm port, and having a housing intake passageway for securing to said water pick output branch of said switch valve, said housing intake passageway opening into said housing entry chamber defined by said housing wall and by a first face of said flexible shuttle diaphragm, and having a housing output passageway for securing to said water pick tube, said housing output passageway opening from said housing exit chamber defined by said housing wall and a second face of said flexible shuttle diaphragm, a pulsing mechanism within said housing and comprising said flexible shuttle diaphragm and a double valve assembly passing through said diaphragm port; said double valve assembly comprising an entry chamber valve controlling water flow between said entry chamber and the exterior of said housing, which closes to permit water pressure to rise within said entry chamber and which opens to permit water to escape from said entry chamber through said housing wall to cause water pressure to fall within said entry chamber, and comprising an exit chamber check valve which opens to permit water to flow from said entry chamber into said exit chamber and out of said housing output passageway to said water pick when said entry chamber valve is closed, and which closes to prevent water flow from said exit chamber and from said housing output passageway and water pick from entering said entry chamber when said entry chamber valve is open and water pressure within said entry chamber is thus lower, thereby permitting water pressure within said exit chamber to remain stable while resilient force of a diaphragm spring bearing against said diaphragm deflects said diaphragm back into said entry chamber, overcoming diminished force of lower entry chamber water pressure, and said diaphragm deflection cycle repeats to produce water pulses passing through said housing output passageway and through said water pick tube and said water pick, wherein said double valve assembly is a single assembly defining both said entry chamber valve and said exit chamber check valve, said entry chamber valve further includes a valve tube slidably retained within a valve tube guide sleeve mounted within an entry chamber valve tunnel in portion of said housing wall forming part of said entry chamber and an opposing exit chamber valve tunnel in the portion of said housing wall forming a housing cap part of said housing exit chamber, said valve tube has diametrically opposing guide tube ports opening into said housing entry chamber outside said entry chamber valve tunnel, said valve tube also has a diametrically protruding guide bar riding within diametrically opposing guide slots in said valve tube guide sleeve which narrows toward the exit chamber end of said valve tube guide sleeve in a guide slot stop step which said guide bar abuts as said valve tube advances toward said exit chamber causing the valve tube guide sleeve to begin advancing with said valve tube toward said exit chamber, wherein said exit chamber check valve includes the valve tube internal surface and the valve tube internal diameter expands at a valve tube internal bevel substantially where said valve tube passes through said diaphragm port in said diaphragm to define a bullet shuttle raceway within the portion of said valve tube within said exit chamber, and a bullet shuttle in the form of a solid cylinder having a bullet-nose shape at each longitudinal end rides loosely and freely within said bullet shuttle raceway, lodgingly sealingly in said valve tube internal bevel at one end of said bullet shuttle raceway, and abutting a bullet shuttle stop structure protruding from said housing wall to the opposing end of said raceway; and a water pick secured to said tube second end, wherein said water pick comprises: a tubular pick body in the form of a pick handle segment comprising a pick valve and having a handle segment first end secured to said tube second end and a pick handle segment second end to which a nozzle is secured.

2. The apparatus of claim 1, additionally comprising a tube supporting hook protruding laterally from said first pipe segment for hanging said water pick tube.

3. The apparatus of claim 1, wherein said water pick tube is a hydrodynamic hose.

4. The apparatus of claim 1, wherein said water pulsing unit has an externally threaded fitting and wherein said tube first end comprises a tube attachment nut for securing said tube first end to said water pulsing unit.

5. The apparatus of claim 1, wherein said pick valve comprises an actuator button for turning said water pick on and off.

6. A water pick and pick connection fitting apparatus, comprising:

a pipe T-fitting comprising a first pipe segment defining a water receiving segment for attachment to a water supply pipe, and an output branch in fluid communication with said first pipe segment and to which a water shower head is connected, a water pick output branch in fluid communication with said first pipe segment; and a water pick assembly attached to said water pick output branch, wherein said water pick assembly comprises: a water pulsing unit connected to said water pick output branch, a water pick tube having a tube first end and a tube second end, said tube first end being connected to said water pulsing unit, and a water pick secured to said tube second end, wherein said water pick comprises: a tubular pick body in the form of a pick handle segment comprising a pick valve and having a handle segment first end secured to said tube second end and a pick handle segment second end to which a nozzle is secured, wherein said water pulsing unit comprises: a water pulsing unit housing having a housing wall and containing a flexible shuttle diaphragm peripherally mounted within said housing and dividing the interior of said housing into a housing entry chamber and a housing exit chamber and having a central diaphragm port, and having a housing intake passageway for securing to said water pick output branch of said switch valve, said housing intake passageway opening into said housing entry chamber defined by said housing wall and by a first face of said flexible shuttle diaphragm, and having a housing output passageway for securing to said water pick tube, said housing output passageway opening from said housing exit chamber defined by said housing wall and a second face of said flexible shuttle diaphragm, a pulsing mechanism within said housing and comprising said flexible shuttle diaphragm and a double valve assembly passing through said diaphragm port; said double valve assembly comprising an entry chamber valve controlling water flow between said entry chamber and the exterior of said housing, which closes to permit water pressure to rise within said entry chamber and which opens to permit water to escape from said entry chamber through said housing wall to cause water pressure to fall within said entry chamber, and comprising an exit chamber check valve which opens to permit water to flow from said entry chamber into said exit chamber and out of said housing output passageway to said water pick when said entry chamber valve is closed, and which closes to prevent water flow from said exit chamber and from said housing output passageway and water pick from entering said entry chamber when said entry chamber valve is open and water pressure within said entry chamber is thus lower, thereby permitting water pressure within said exit chamber to remain stable while resilient force of a diaphragm spring bearing against said diaphragm deflects said diaphragm back into said entry chamber, overcoming diminished force of lower entry chamber water pressure, and said diaphragm deflection cycle repeats to produce water pulses passing through said housing output passageway and through said water pick tube and said water pick, wherein said double valve assembly is a single assembly defining both said entry chamber valve and said exit chamber check valve, said entry chamber valve further includes a valve tube slidably retained within a valve tube guide sleeve mounted within an entry chamber valve tunnel in portion of said housing wall forming part of said entry chamber and an opposing exit chamber valve tunnel in the portion of said housing wall forming a housing cap part of said housing exit chamber, said valve tube has diametrically opposing guide tube ports opening into said housing entry chamber outside said entry chamber valve tunnel, said valve tube also has a diametrically protruding guide bar riding within diametrically opposing guide slots in said valve tube guide sleeve which narrows toward the exit chamber end of said valve tube guide sleeve in a guide slot stop step which said guide bar abuts as said valve tube advances toward said exit chamber causing the valve tube guide sleeve to begin advancing with said valve tube toward said exit chamber, wherein said exit chamber check valve includes the valve tube internal surface and the valve tube internal diameter expands at a valve tube internal bevel substantially where said valve tube passes through said diaphragm port in said diaphragm to define a bullet shuttle raceway within the portion of said valve tube within said exit chamber, and a bullet shuttle in the form of a solid cylinder having a bullet-nose shape at each longitudinal end rides loosely and freely within said bullet shuttle raceway, lodgingly sealingly in said valve tube internal bevel at one end of said bullet shuttle raceway, and abutting a bullet shuttle stop structure protruding from said housing wall to the opposing end of said raceway.

7. The apparatus of claim 6, additionally comprising a valve in said pipe T-fitting for diverting water flow alternately between the water output pipe and said water pulsing and pick assembly.

8. The apparatus of claim 6, additionally comprising a tube supporting hook protruding laterally from said first pipe segment for hanging said water pick tube.

9. The apparatus of claim 6, wherein said water pick tube is a hydrodynamic hose.

10. The apparatus of claim 6, wherein said tub first end comprises a tube attachment nut for securing said tube first end to said water pulsing unit.

11. The apparatus of claim 6, wherein said pick valve comprises an actuator button for turning said water pick on and off.

* * * * *